US007847779B2

(12) United States Patent
Liao

(10) Patent No.: US 7,847,779 B2
(45) Date of Patent: Dec. 7, 2010

(54) METHOD AND APPARATUS OF TRANSMITTING DATA SIGNALS AND CONTROL SIGNALS VIA AN LVDS INTERFACE

(75) Inventor: Chien-Chuan Liao, Taipei County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 777 days.

(21) Appl. No.: 11/538,814

(22) Filed: Oct. 5, 2006

(65) Prior Publication Data

US 2007/0229434 A1 Oct. 4, 2007

(30) Foreign Application Priority Data

Mar. 29, 2006 (TW) ..... 95111019 A

(51) Int. Cl.
*G09G 3/36* (2006.01)
*G09G 5/00* (2006.01)

(52) U.S. Cl. ..... 345/99; 345/204

(58) Field of Classification Search ..... 345/204–213, 345/87–102, 76, 82, 60, 690–699
See application file for complete search history.

(56) References Cited

U.S. PATENT DOCUMENTS

| | | | | |
|---|---|---|---|---|
| 6,326,958 | B1 * | 12/2001 | Gorny et al. | 345/204 |
| 6,487,614 | B2 * | 11/2002 | Nobutani et al. | 710/20 |
| 7,167,141 | B2 * | 1/2007 | Goto et al. | 345/1.1 |
| 7,664,015 | B2 * | 2/2010 | Price et al. | 370/229 |
| 2004/0196279 | A1 * | 10/2004 | Kim et al. | 345/211 |
| 2005/0110809 | A1 * | 5/2005 | Tung et al. | 345/690 |
| 2005/0275644 | A1 * | 12/2005 | Shen et al. | 345/204 |

* cited by examiner

*Primary Examiner*—Stephen G Sherman
(74) *Attorney, Agent, or Firm*—Winston Hsu; Scott Margo

(57) ABSTRACT

A display method transmits data signals and control signals via an LVDS interface. The display method includes transmitting data codes corresponding to a control signal using a reserved bit of a channel of the LVDS interface, and generating the control signal for a display panel by decoding the data codes using a decoder of a timing controller.

13 Claims, 7 Drawing Sheets

METHOD AND APPARATUS OF TRANSMITTING DATA SIGNALS AND CONTROL SIGNALS VIA AN LVDS INTERFACE

BACKGROUND OF THE INVENTION

1. Field of the Invention

The present invention provides a method and apparatus of transmitting data signals and control signals, and more particularly, to a method and apparatus of transmitting control signals via a reserved bit of an LVDS interface.

2. Description of the Prior Art

Liquid crystal display (LCD) devices are flat panel displays characterized by thin appearance, low radiation and low power consumption. LCD devices have gradually replaced traditional cathode ray tube (CRT) displays, and been widely applied in various electronic products such as notebook computers, personal digital assistants (PDAs), flat panel televisions, or mobile phones. An LCD device usually includes an LCD panel, a timing controller, a gate driver, and a source driver. The timing controller generates data signals corresponding to display images, together with control signals and clock signals for driving the LCD panel. The source driver generates driving signals based on the data signals, the control signals and the clock signals received from the timing controller. For displaying images correctly, various signals are transmitted from the timing controller to the source drivers via an interface. Common interfaces used in an LCD device include transistor-transistor logic (TTL) interfaces, reduced swing differential signal (RSDS) interfaces, low voltage differential signal (LVDS) interfaces, and mini low voltage differential signal (mini-LVDS) interfaces, etc.

Reference is made to FIG. 1 for a diagram of a prior art LCD application system 10. The LCD application system 10 includes a panel control device 12 and an LCD device 14. Signals are transmitted between the panel control device 12 and the LCD device 14 via an LVDS bus. The panel control device 12 generates image signals $D_{IMAGE}$, a horizontal synchronization signal HS, a vertical synchronization signal VS, and a data enable signal DE, etc. The LCD device 14 includes a timing controller 16 and a display panel 18. Based on the horizontal synchronization signal HS, the vertical synchronization signal VS, and the data enable signal DE, the timing controller 16 generates a start pulse signal SP, a data load signal LD, and a polarity signal POL for operating the LCD panel 18. Based on the image signals $D_{IMAGE}$, the timing controller 16 generates data signals DATA corresponding to display images of the LCD panel 18. Since an LVDS bus is used as a signal transmission interface between the panel control device 12 and the LCD device 14, an LVDS transmitter is disposed on the panel control device 12. The signals $D_{IMAGE}$, HS, VS and DE are outputted via channels TX0-TX3 of the LVDS transmitter, and the clock signal is outputted via a TCLK channel of the LVDS transmitter. Similarly, an LVDS receiver is disposed on the timing controller 16. The signals $D_{IMAGE}$, HS, VS and DE outputted by the LVDS transmitter are received via channels RX0-RX3 of the LVDS receiver, and the clock signal is received via a RCLK channel of the LVDS receiver.

Reference is made to FIG. 2 for a signal diagram illustrating the operation of the LCD application system 10. FIG. 2 depicts signals outputted via the channels TX0, TX1, TX2, TX3 and TCLK of the LVDS transmitter, in which eight red image data signals R0-R7, eight green image data signals G0-G7, eight blue image data signals B0-B7, the horizontal synchronization signal HS, the vertical synchronization signal VS, and the data enable signal DE are being transmitted. Within a cycle as illustrated in FIG. 2, the LVDS transmitter outputs the data signals R0-R5 and G0 via the channel TX0, outputs the data signals G1-G5 and B0-B1 via the channel TX1, outputs the data signals B2-B5, the horizontal synchronization signal HS, the vertical synchronization signal VS, and the data enable signal DE via the channel TX2, and outputs the data signals R6-R7, G6-G7 and B6-B7 via the channel TX3. In the LVDS bus specifications, the channel TX3 includes a reserved bit which is not used for signal transmission. Therefore in the prior art LCD application system 10, data outputted via the channel TX3 in a cycle is one bit less than that outputted via other channels.

Reference is made to FIG. 3 for a diagram of a prior art LCD device 30. The LCD device includes a gamma power generator 32, a timing controller 36, a display panel 38, and source drivers CD1-CDn. The timing controller 36 receives the image signals $D_{IMAGE}$, the horizontal synchronization signal HS, the vertical synchronization signal VS, and the data enable signal DE provided by an external system via an LVDS receiver, and generates the start pulse signal SP, the data load signal LD, and the polarity signal POL for operating the LCD panel 38. Also, the gamma power generator 32 provides a gamma DC voltage $V_{GAMMA}$ and a common voltage $V_{COM}$ for operating each source driver. The DC voltage $V_{COM}$ is the basis for performing gamma DC voltage $V_{GAMMA}$ conversion in each source driver. If the gamma DC voltage $V_{GAMMA}$ and the common voltage $V_{COM}$ deviate from the predetermined values due to device characteristic variations or system mismatches, brightness irregularities may occur when the display panel 38 display images of the same gray scale. This kind of flicking largely influences the display quality of the LCD device 30. Therefore, the LCD device 30 usually includes variable resistors for manually adjusting the value of the common voltage $V_{COM}$.

Also, an LCD device displays images having different gray scales by changing the rotations of liquid crystal modules. For human eyes, each frame appears as an independent image. When displaying consecutive frames, human eyes perceive overlapped images of two consecutive frames as a result of persistence of vision. The kind of image overlapping is more obvious when an LCD device displays motional images. Image overlapping can be reduced by increasing the response speed of the liquid crystal material, but the response speed has its upper limit. Usually a technique known as black image insertion is introduced for inserting black images between two consecutive frames and thereby providing fast pulse modulation effect similar to that provided by the CRT devices. Human brains automatically filter image flickering and generate intermediate images, which can thus reduce the visual effect of image overlapping. Since the maximum vertical synchronization frequency provided by most LCD devices is 75 Hz, the frame has to be updated every 13.3 microseconds. Therefore, when using the black image insertion technique, a black image has to be switched to a normal image within 6.66 (13.3/2) microseconds, and a normal image has to be switched to a black image within 6.66 microseconds plus a vertical blanking period. The purpose is to prevent the brightness of a normal image from being influenced by a black image, or from being overlapped by a normal image of the next frame.

As a result, a technique known as over-driving is further introduced together with the black image insertion for increasing the response speed of the liquid crystal material. An over-driving circuit is disposed on a scaler that generates display images of an LCD panel, and a black image insertion circuit is disposed on the LCD panel. If the LCD panel provides black image insertion function, a scaler capable of supporting over-driving has to be used and the manufacturing process is very complicated. Besides, although over-driving and black image insertion techniques can reduce visual effects caused by image overlapping when displaying motional images, image contrast distortions can occur when displaying static images.

SUMMARY OF THE INVENTION

The claimed invention discloses a display system using an LVDS interface for transmitting data signal and control signals comprising a display panel for displaying images, a panel control circuit, a timing controller, an LVDS interface, and a plurality of source drivers. The panel control circuit comprises an image signal generator for generating image signals, a synchronization signal generator for generating synchronization signals, and a control signal generator for generating control signals required for operating the display panel. The timing controller includes a decoder for generating corresponding output signals based on the image signals, the synchronization signals and the control signals received from the panel control circuit. The LVDS interface is coupled to the panel control circuit and the timing controller and comprises an LVDS transmitter and an LVDS receiver. The LVDS transmitter of the LVDS interface is coupled to the panel control circuit and includes a plurality of transmitting channels for outputting the image signals, the synchronization signals and the control signals generated by the panel control circuit. The LVDS receiver of the LVDS interface is coupled to the timing controller and includes a plurality of receiving channels for receiving the image signals, the synchronization signals and the control signals transmitted via the plurality of transmitting channels. The plurality of source drivers are coupled to the timing controller for generating corresponding panel control signals based on the output signals generated by the timing controller.

The claimed invention further discloses a display method for transmitting data signals and control signals using an LVDS interface comprising transmitting data codes corresponding to control signals via a reserved bit of a channel of the LVDS interface, and a decoder of a timing controller receiving and decoding the data codes corresponding to the control signals and thereby generating control signals for a display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
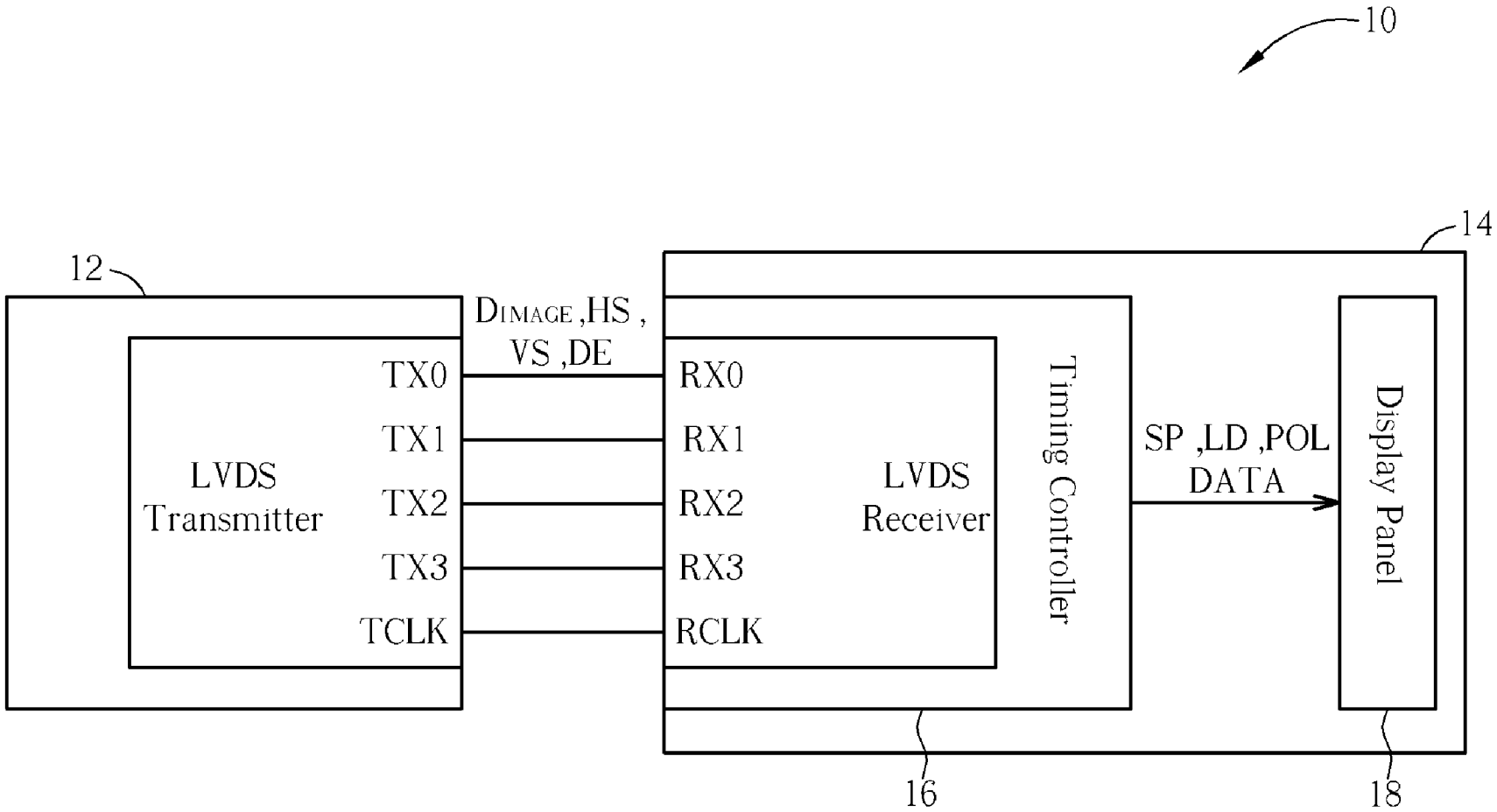
Fig. 1 Prior art
FIG. 1 is a diagram of a prior art LCD application system.
Figure 2:
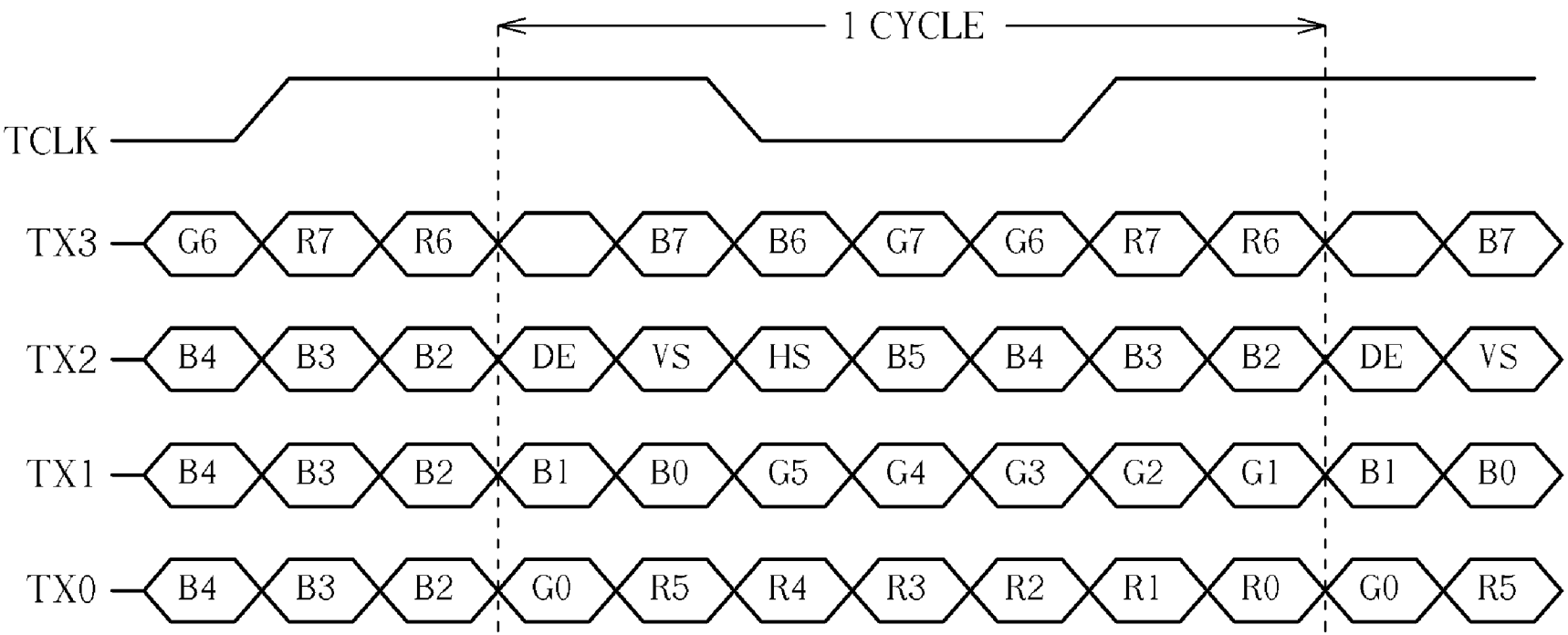
Fig. 2 Prior art
FIG. 2 is a signal diagram illustrating the operation of the LCD application system in FIG. 1.
Figure 3:
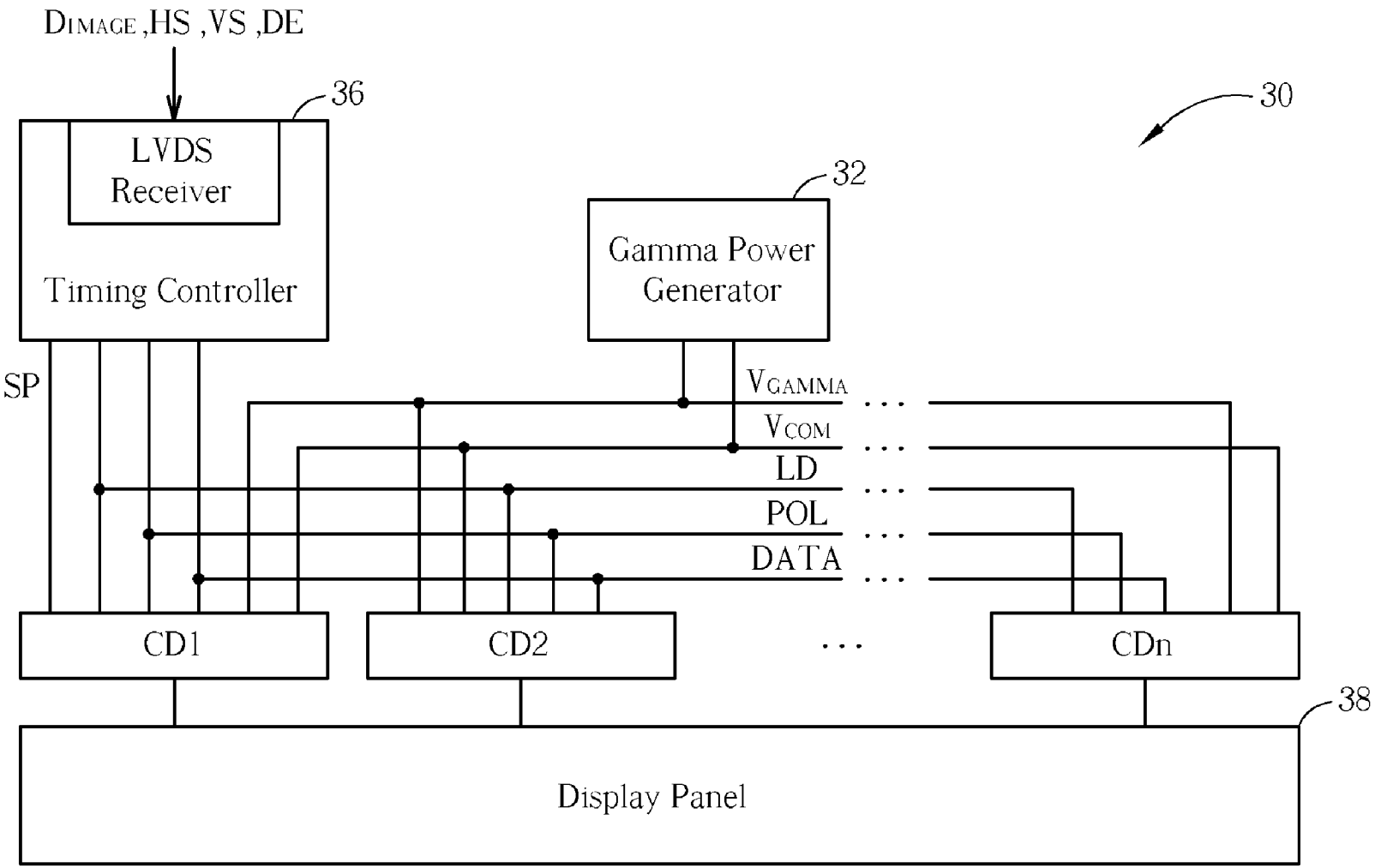
Fig. 3 Prior art
FIG. 3 is a diagram of a prior art LCD device.
Figure 4:
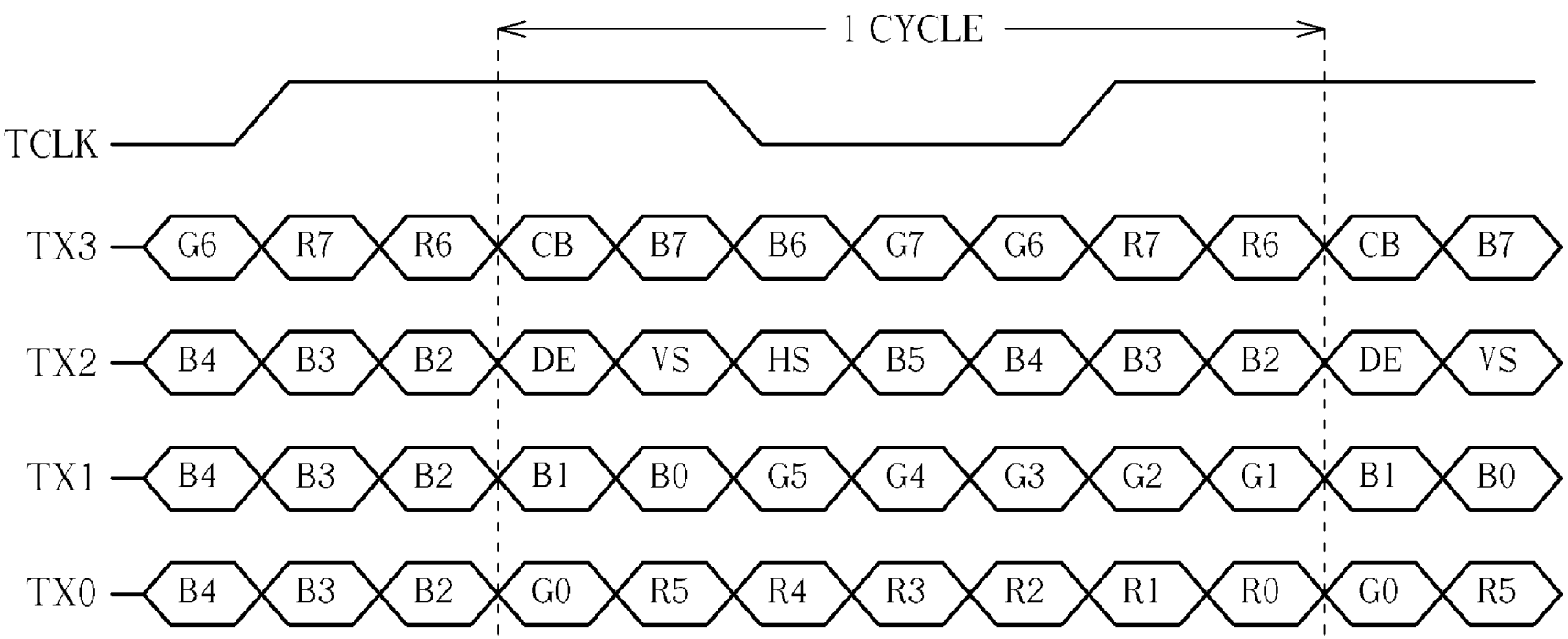
FIG. 4 is a signal diagram illustrating the operation of an LCD application system according to the present invention.

Reference is made to FIG. 4 for a signal diagram illustrating the operation of an LCD application system according to the present invention. FIG. 4 also depicts signals outputted via the channels TX0, TX1, TX2, TX3 and TCLK of the LVDS transmitter, in which eight red image data signals R0-R7, eight green image data signals G0-G7, eight blue image data signals B0-B7, the horizontal synchronization signal HS, the vertical synchronization signal VS, and the data enable signal DE are being transmitted. Within a cycle as illustrated in FIG. 4, the LVDS transmitter outputs the data signals R0-R5 and G0 via the channel TX0, outputs the data signals G1-G5 and B0-B1 via the channel TX1, outputs the data signals B2-B5, the horizontal synchronization signal HS, the vertical synchronization signal VS, and the data enable signal DE via the channel TX2, and outputs the data signals R6-R7, G6-G7 and B6-B7 via the channel TX3. At the same time, the reserved bit of the channel TX3 (represented by CB in FIG. 4) is used for transmitting a control signal of the timing controller. Therefore, a user can change various settings of the timing controller flexibly.

Figure 5:
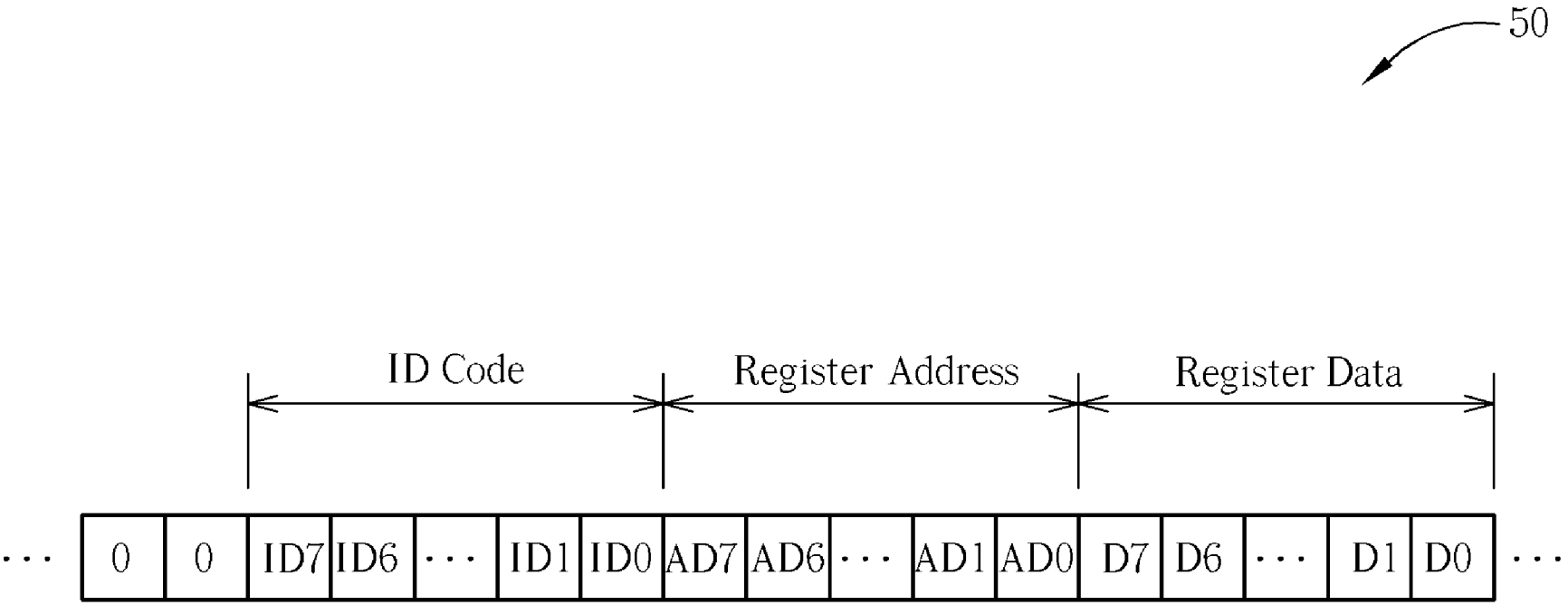
FIG. 5 is a diagram illustrating a data code transmitted via a reserved bit of a channel according to the present invention.

Reference is made to FIG. 5 for a diagram illustrating a data code 50 transmitted via the reserved bit CB of the channel TX3 according to the present invention. In FIG. 5, each bit of the data code 50 is depicted, and the data code 50 is transmitted in a left-to-right sequence. First, after resetting the system, the panel control device outputs data 0 via the reserved bit CB of the channel TX3. If the user wants to change a certain setting of the timing controller, the panel control device outputs a corresponding ID code of the setting, a register address at which the setting is stored, and register data for updating the previously stored setting via the reserved bit CB of the channel TX3. In the embodiment shown in FIG. 5, the ID code, the register address and the register data each include eight bits and are respectively represented by ID0-ID7, AD0-AD7 and D0-D7. In the present invention, the ID code of each setting can be pre-defined. After receiving the ID code comprising ID0-ID7, the timing controller checks whether the received ID code corresponds to a certain setting. If the received ID code corresponds to a certain setting, the timing controller continues to receive the register address comprising AD0-AD7 and the register data comprising D0-D7. The timing controller can then locate the address at which the setting is stored based on the received register address AD0-AD7, and update the stored data based on the received register data D0-D7.

Figure 6:
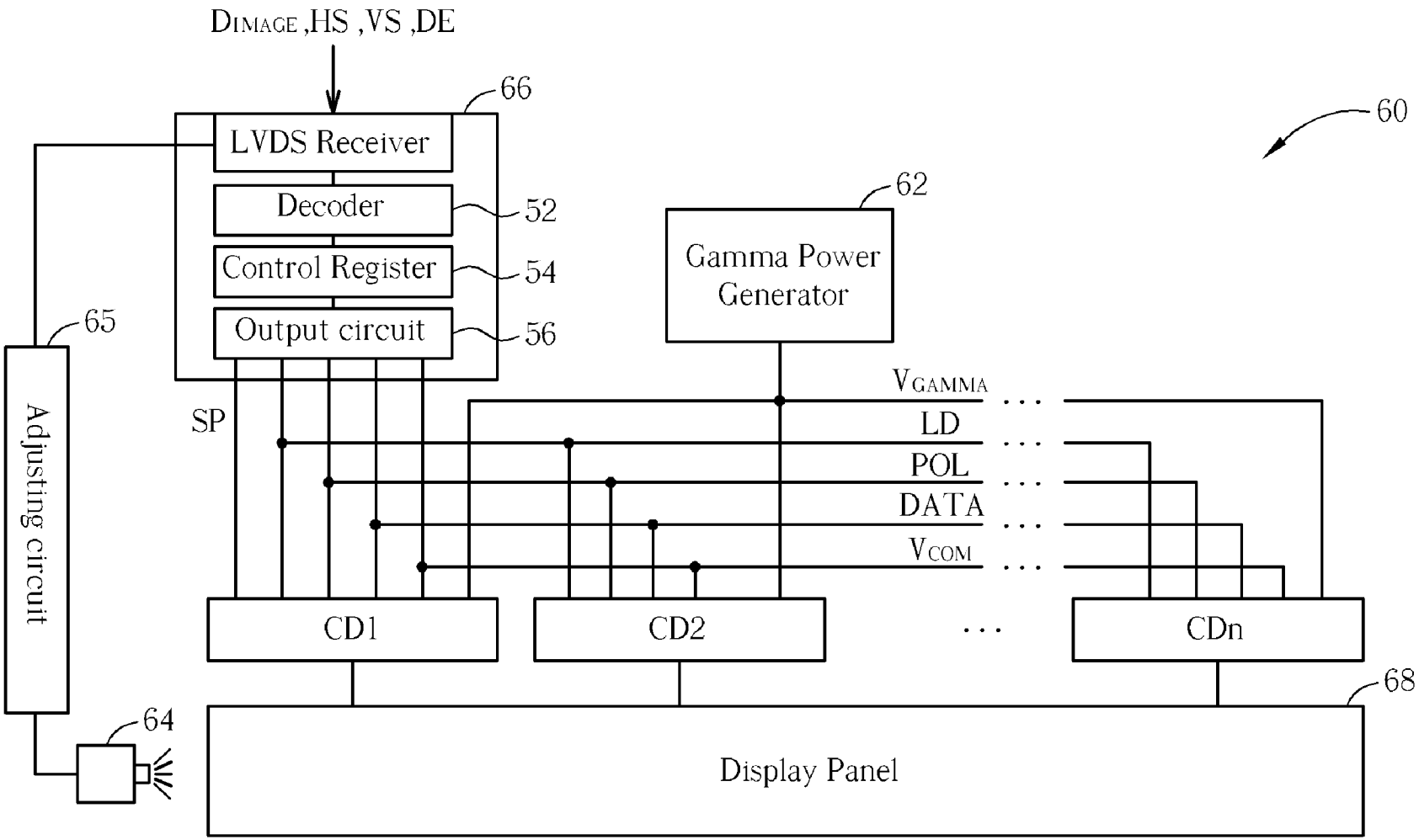
FIG. 6 is a diagram of an LCD device according to the present invention.

Reference is made to FIG. 6 for a diagram of an LCD device 60 according to the present invention. The LCD device 60 includes a gamma power generator 62, a sensor 64, an adjusting circuit 65, a timing controller 66, a display panel 68, and source drivers CD1-CDn. The timing controller 66 includes a decoder 52, a control register 54, and an output circuit 56. The timing controller 66 receives the image signals $D_{IMAGE}$, the horizontal synchronization signal HS, the vertical synchronization signal VS, and the data enable signal DE provided by an external system via an LVDS receiver, and generates the start pulse signal SP, the data load signal LD, and the polarity signal POL for operating the LCD panel 68. The gamma power generator 62 merely provides a gamma DC voltage $V_{GAMMA}$ for operating each source driver, while a common voltage $V_{COM}$ for performing gamma DC voltage conversion in each source driver is also provided by the timing controller 66. In this embodiment, the output circuit 56 can include a digital-to-analog converter or a pulse width modulation (PWM) unit.

The sensor 64 is disposed on the display panel 68 for detecting brightness variations of the display panel 68 and sending the detected brightness variations to the adjusting circuit 65. Based on the brightness variations, the adjusting circuit 65 calculates an appropriate common voltage $V_{COM}$ corresponding to the current brightness, generates a data code corresponding to the appropriate common voltage $V_{COM}$, and then sends the data code to the timing controller 66 via the reserved bit CB of the channel TX3. The decoder 52 of the timing controller 66 receives and decodes the data code transmitted via the reserved bit CB of the channel TX3, thereby generating the ID code corresponding to the common voltage, the address of the control register 54 for storing the common voltage, and data corresponding to the appropriate common voltage $V_{COM}$. The timing controller 66 can then update the setting of the control register 54 accordingly so as to provide the source drivers CD1-CDn with the appropriate common voltage $V_{COM}$ via the output circuit 56. In conclusion, the present LCD device 60 measures the brightness variations of the display panel 68 using the sensor 64, calculates the most appropriate common voltage $V_{COM}$, and sends the control signals corresponding to most appropriate common voltage $V_{COM}$ to the timing controller 66 via the reserved bit CB of the channel TX3. Therefore, the timing controller 66 can provide the source drivers CD1-CDn with the most appropriate common voltage $V_{COM}$.

Figure 7:
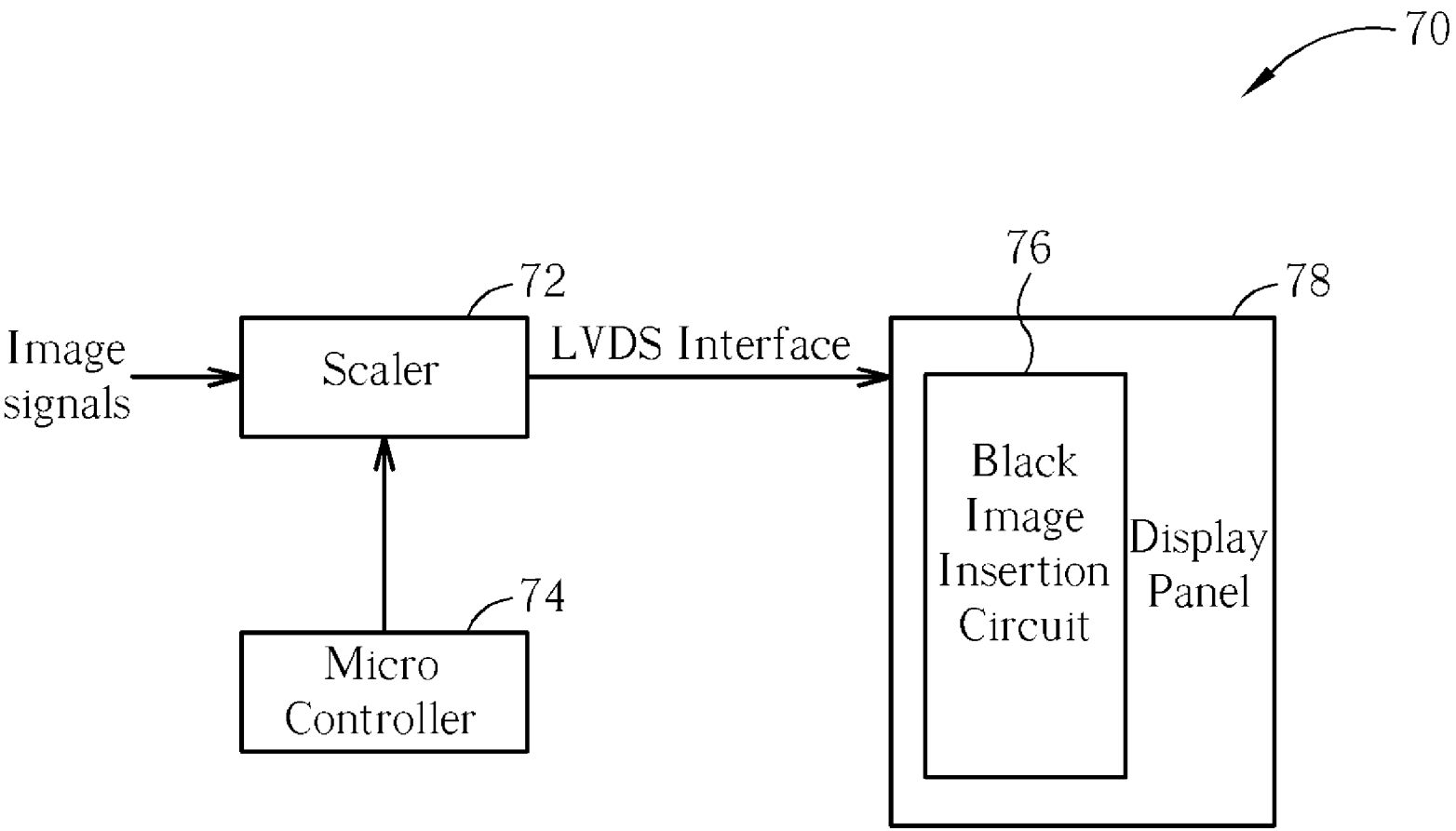
FIG. 7 is a functional diagram of an LCD device according to the present invention.

Reference is made to FIG. 7 for a functional diagram of an LCD device 70 according to the present invention. The LCD device 70 includes a scaler 72, a micro controller 74, a black image insertion circuit 76, and a display panel 78. The black image insertion circuit 76 is disposed on the display panel 78 for reducing image overlapping by inserting black images between two consecutive frames. The scaler 72 is coupled to the display panel 78 via an LVDS interface for receiving image signals, adjusting the resolution and size of the image signals, and sending the adjusted image signals to the display panel 78 via the LVDS interface. A user can activate or de-activate the black image insertion circuit 76 using an on screen display (OSD) or other control interfaces. Or, the LCD device 70 can determine whether the black image insertion circuit 76 should be activated. The micro controller 74 can generate corresponding enabling/disabling signals, which are then transmitted to the black image insertion circuit 76 on the display panel 78 via the reserved bit CB of the channel TX3. Therefore, the LCD device 70 according to the present invention can flexibly activate or de-activate the black image insertion circuit 76 without using a scaler that supports an over-driving function. The present invention can reduce visual effects caused by image overlapping when displaying motional images without causing image contrast distortions when displaying static images.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display system using a low voltage differential signal (LVDS) interface for transmitting data signal and control signals comprising:

a display panel for displaying images;

a panel control circuit;

a timing controller including a decoder for generating corresponding output signals based on received image signals, synchronization signals and control signals;

an LVDS interface coupled to the panel control circuit and the timing controller comprising:

an LVDS transmitter coupled to the panel control circuit and including a plurality of transmitting channels for outputting the image signals, the synchronization signals and the control signals generated by the panel control circuit; and an LVDS receiver coupled to the timing controller and including a plurality of receiving channels for receiving the image signals, the synchronization signals and the control signals transmitted via the plurality of transmitting channels, wherein a control signal of the timing controller is transmitted via a reserved bit of a channel TX3 of the LVDS interface for changing a setting of the timing controller, the reserved bit of the channel TX3 of the LVDS interface being a bit that is not officially used for signal transmission according to the LVDS bus specification; and a plurality of source drivers coupled to the timing controller for generating corresponding panel control signals based on the output signals generated by the timing controller.

2. The display system of claim 1 further comprising:

a gamma power generator coupled to the plurality of source drivers for providing gamma direct current (DC) power required for operating each source driver; and a sensor disposed on the display panel for measuring brightness variations of images displayed on the display panel;

wherein a correction circuit is coupled to the sensor and the LVDS transmitter for calculating a corresponding common voltage based on the measured brightness variations, thereby generating data codes corresponding to the common voltage.

3. The display system of claim 2 wherein the timing controller comprises:

a control register coupled to the decoder for receiving the data codes corresponding to the common voltage and updating settings corresponding to the common voltage based on the received data codes.

4. The display system of claim 3 wherein the timing controller further comprises:

a digital-to-analog converter coupled to the control register for outputting a corresponding common voltage based on the settings of the control register.

5. The display system of claim 3 wherein the timing controller further comprises:

a pulse width modulation (PWM) unit coupled to the control register for outputting a corresponding common voltage based on the settings of the control register.

6. The display system of claim 1 further comprising:

a black image insertion circuit disposed on the display panel for inserting black images between two display frames of the display panel;

wherein a micro controller generates an enabling/disabling signal for the black image insertion circuit.

7. The display system of claim 6 further comprising:

a scaler coupled to the panel control circuit and the micro controller for receiving the image signals from the panel control circuit, adjusting resolutions and sizes of the image signals, and outputting the adjusted image signals to the display panel.

8. A display method for transmitting data signals and control signals using an LVDS interface comprising:

transmitting data codes corresponding to control signals of the timing controller via a reserved bit of a channel TX3 of the LVDS interface for changing a setting of the timing controller, the reserved bit of the channel TX3 of the LVDS interface being a bit that is not officially used for signal transmission according to the LVDS bus specification; and a decoder of a timing controller receiving and decoding the data codes corresponding to the control signals and thereby generating control signals for a display panel.

9. The display method of claim 8 further comprising:

transmitting data codes corresponding to image signals and synchronization signals via other channels of the LVDS interface.

10. The display method of claim 8 further comprising:

transmitting data codes corresponding to image signals and synchronization signals via other bits of the channel of the LVDS interface.

11. The display method of claim 8 further comprising:

generating the data codes corresponding to the control signals, the image signals, and the synchronization signals.

12. The display method of claim 8 wherein transmitting data codes corresponding to control signals via a reserved bit of a channel of the LVDS interface comprises transmitting data codes corresponding to a common voltage.

13. The display method of claim 8 wherein transmitting data codes corresponding to control signals via a reserved bit of a channel of the LVDS interface comprises transmitting data codes corresponding to an enabling/disabling signal of a black image insertion circuit.

* * * * *